US007324780B2

(12) United States Patent
Yamada et al.

(10) Patent No.: US 7,324,780 B2
(45) Date of Patent: Jan. 29, 2008

(54) IMAGE FORMING APPARATUS, WASTE TONER TANK, AND A METHOD OF MOVING WASTE TONER

(75) Inventors: Mitsuru Yamada, Itabashi-ku (JP); Yutaka Fukuchi, Yokohama (JP); Arai Yuji, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 11/210,661

(22) Filed: Aug. 25, 2005

(65) Prior Publication Data

US 2006/0045594 A1 Mar. 2, 2006

(30) Foreign Application Priority Data

Aug. 25, 2004 (JP) ..... 2004-245503
Jul. 25, 2005 (JP) ..... 2005-214624

(51) Int. Cl.
*G03G 21/00* (2006.01)

(52) U.S. Cl. ..... 399/358; 399/35; 399/360

(58) Field of Classification Search ..... 399/35, 399/107, 120, 358, 359, 360
See application file for complete search history.

(56) References Cited

U.S. PATENT DOCUMENTS 5,121,168 A * 6/1992 Aoki et al. ..... 399/359
5,176,374 A 1/1993 Yamada
5,634,172 A * 5/1997 Manabe ..... 399/35
2004/0247349 A1 12/2004 Takahashi et al.
2004/0257430 A1 12/2004 Takahashi et al.

FOREIGN PATENT DOCUMENTS

JP 2003-202728 7/2003
JP 2004-117392 4/2004
JP 2004-080065 11/2004
JP 2005-315953 * 11/2005

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a waste toner collecting unit, a moving device, a sheet conveying roller, a driving unit, and a drive force transmitting unit. The waste toner collecting unit receives waste toner. The moving device moves the waste toner in the waste toner collecting unit. The sheet conveying roller transports a transfer sheet. The driving unit drives the sheet conveying roller. The drive force transmitting unit interlinks the moving device to the sheet conveying roller, and transmits a drive force of the driving unit to the moving device via a shaft of the sheet conveying roller.

24 Claims, 12 Drawing Sheets

IMAGE FORMING APPARATUS, WASTE TONER TANK, AND A METHOD OF MOVING WASTE TONER

CROSS-REFERENCE TO RELATED APPLICATIONS

This application claims priority from Japanese patent applications No. 2004-245503 filed on Aug. 25, 2004, and No. 2005-214624 filed on Jul. 25, 2005 in the Japan Patent Office, the entire contents of each of which are hereby incorporated herein by reference.

BACKGROUND OF THE INVENTION

1. Field of the Invention

The present disclosure generally relates to an image forming apparatus having a sheet conveying system and a waste toner tank, and more particularly to a moving system configured to be moved by a driving force transmitted via a sheet conveying system.

2. Discussion of the Background

As for an image forming apparatus such as a copying machine, a facsimile machine, a laser beam printer, it is necessary, for various reasons, to prevent sheet conveying rollers from being reversed.

For example, to correct a skew feed of a sheet, a leading edge of the sheet is abutted against a nip portion of a pair of registration rollers, and the sheet is conveyed for some distance by sheet conveying rollers disposed upstream of the registration rollers in a sheet conveying direction to form a loop of the sheet.

At this time, unless a reverse preventing mechanism for preventing the sheet conveying rollers from being reversed is provided, the sheet conveying rollers may be rotated in a reverse direction (i.e., in the direction opposite to the sheet conveying direction) due to a tension of the sheet.

As a result, the loop of the sheet disappears, resulting in an inferior sheet skew correction. At worst, the leading edge of the sheet retreats from the nip portion of the registration rollers toward the sheet conveying rollers so that a miss-feeding of the sheet occurs.

Generally, a sheet separation roller is disposed upstream of the sheet conveying rollers in the sheet conveying direction. The sheet separation roller rotates in a reverse direction to separate the uppermost sheet from the sheets fed out from a sheet feeding cassette.

The above-described inferior sheet skew correction and miss-feeding of sheets are typically caused when a force is exerted in a sheet returning-back direction.

To obviate the above-described drawbacks, a reverse preventing mechanism for preventing sheet conveying rollers from being reversed is provided in an apparatus that performs a sheet conveying operation.

FIGS. 1, 2A, and 2B illustrate a background reverse preventing mechanism for sheet conveying rollers used in an image forming apparatus.

A roller clutch (one-way clutch) 100 shown in FIG. 1 is generally used as a reverse preventing mechanism.

In the configuration of the roller clutch 100, each of a plurality of needle pins 120 is disposed in a hole-shaped clearance 140 (FIG. 2A) formed between the circumferential surface of a roller shaft 110 and an outer ring 160 such that the plurality of needle pins 120 contact the circumferential surface of the roller shaft 110.

As shown in FIG. 2B, the clearance 140 includes a narrow width portion B and a wide width portion C. Regularly, each of the needle pins 120 is biased by a spring 150 toward the narrow width portion B of the clearance 140. The size of an opening 140*a* of the clearance 140 is set such that the needle pin 120 can be prevented from falling through the clearance 140.

In this configuration of the roller clutch 100, when the roller shaft 110 is rotated in a direction indicated by arrow A in FIGS. 2A and 2B (i.e., a counter-clockwise direction), the needle pin 120 moves toward the narrow width portion B of the clearance 140 due to friction between the needle pin 120 and the roller shaft 110. By catching the needle pin 120 in the narrow width portion B of the clearance 140, the roller shaft 110 and the roller clutch 100 are locked as shown in FIG. 2B.

When the roller shaft 110 is rotated in a reverse direction (i.e., a clockwise direction), the needle pin 120 moves toward the wide width portion C of the clearance 140 by overcoming the biasing force of the spring 150, and thereby the roller shaft 110 rotates freely in the clockwise direction.

The outer ring 160 is disposed between the roller clutch 100 and a holder 130, and has a function of positioning the holder 130 relative to the roller clutch 100.

FIG. 3 is a schematic view of a sheet conveying roller mechanism provided with the background reverse preventing mechanism for use in an image forming apparatus.

As shown in FIG. 3, a plurality of sheet conveying rollers 3 are attached on a roller shaft 35 rotatably disposed between a first side plate 31 and a second side plate 32 via a first bearing 33 and a second bearing 34, respectively.

A plurality of driven rollers 37 attached on a driven shaft 36 contact the sheet conveying rollers 3 with a predetermined pressure, respectively, to convey a sheet without fail by applying a frictional force to the sheet at the nip portions between the sheet conveying rollers 3 and the driven rollers 37.

As shown in FIG. 3, the roller clutch 100 is often used as a bearing by pressing the roller clutch 100 into the second bearing 34 that supports one side of the roller shaft 35.

In an image forming apparatus, the sheet conveying rollers 3 and an image forming device are generally disposed between the pair of first side plate 31 and second side plate 32. A drive system such as gears, motors, and clutches is disposed at the outside of one of the first side plate 31 and second side plate 32. Such a drive system may be disposed on each side of the first side plate 31 and second side plate 32 instead of one side thereof.

However, because wires and gear trains used for a motor and reduction gears need a predetermined space to operate, if such a drive system is disposed on each side of the first side plate 31 and second side plate 32, the width of the apparatus increases. Therefore, the layout of a drive system concentrates on one side of the apparatus in order to save space.

In a recent space-saving printer or multi-function apparatus, the space for the layout of units is restricted, and therefore some units need to be disposed on a side opposite from a drive source relative to a sheet conveying area.

For example, a waste toner tank may be applied to this case. The waste toner tank is preferably disposed at the outside of one of the first side plate 31 and second side plate 32 for easy maintenance.

On the side where a drive system is provided, a motor, a structure for supporting the motor, and shafts for transmitting a drive force of the motor to each unit are disposed.

Further, a waste toner conveying path for conveying waste toner from an image forming device, which is disposed between the first side plate 31 and second side plate 32, to the waste toner tank needs to protrude through one of the first side plate 31 and second side plate 32. Therefore, it is difficult to dispose the drive system and the waste toner tank on the same side of one of the first side plate 31 and second side plate 32.

To drive a unit such as waste toner tank disposed on a side opposite from a first drive source such as motor, a second drive source needs to be provided on a side opposite from the first drive source.

Such an arrangement costs extra money for a motor, a driver, attaching parts, and electric wires. Further, measures against electromagnetic waves and noise generated from electric wires and motors need to be taken on both sides of the first side plate 31 and second side plate 32. Accordingly, the design for the above-described image forming apparatus is complicated.

Moreover, to enhance maintenance of a waste toner tank in an image forming apparatus, it is desirable that the waste toner tank is disposed at the outside of a side plate located on a side opposite from a drive system. This location of the waste toner tank is convenient for a user who replaces the waste toner tank when the waste toner tank is full.

Generally, for safety reasons, the maintenance of a drive system is conducted by a customer engineer. Further, a user replaces a photoconductive member/cleaning unit (PCU) and an intermediate transfer belt unit, for example, by opening a cover disposed on a side opposite from the drive system. It is preferable that the number of covers to be opened for maintenance is reduced to a minimum. Therefore, the same cover to be opened for maintenance is preferably shared among the waste toner tank, the PCU, and the intermediate transfer belt unit.

When the above-mentioned background art is applied to an image forming apparatus capable of color copying, a plurality of image forming devices (e.g., process cartridges) are provided in a slanted manner to save space in the image forming apparatus and to improve productivity of the image forming apparatus.

Therefore, the waste toner is piled at a position, which is lower than a toner ejection port of the image forming devices, in a waste toner tank, and a waste toner transporter (e.g., auger) is provided in a slanted manner for flattening a height of the piled waste toner in the waste toner tank. In such a case, the auger may be driven by a roller, for example. Such a roller may be a registration roller, a sheet conveying roller, a sheet feed roller, a sheet ejection roller, for example.

If a sheet ejection roller is used as a drive roller, a timing belt and a plurality of gears are required to drive the waste toner transporter (e.g., auger) because a distance between the sheet ejection roller and the waste toner transporter (e.g., auger) is long. Accordingly, the image forming apparatus unfavorably increases its required space and cost. In addition, a detachment of the process cartridges may be hindered in such a configuration.

As above-mentioned, toner ejected from the image forming devices (e.g., process cartridges) after image transfer is recovered in the waste toner tank. Such toner may be piled in a mountain shape when recovered in the waste toner tank.

Such toner may be piled in a shape having a plurality of mountains and valleys because an amount of recovered toner may vary for each color toner. Therefore, such mountains and valleys should be flattened by using a screw-shaped auger which moves toner from one place to another. If such a flattening operation is not conducted properly, some drawbacks may happen as discussed below.

In one case, a toner sensor may detect that the waste toner tank is full of waste toner even if some space still remains in the waste toner tank. In another case, waste toner may be piled at a toner ejection port and clog a waste toner pipe, thereby toner may not be ejected from the toner ejection port.

In the case of a color copying machine, the amount of waste toner of each color is different because the amount of toner to be used for image forming depends on the colors most often printed. Accordingly, the flattening operation of the waste toner for a color copying machine is more demanding than for a monochrome copying machine.

Although the amount of waste toner may depend on the types of toner used, process conditions, and environmental conditions, it is preferable to rotate a waste toner transporter (e.g., auger) as long as possible when an image forming operation is conducted.

In one case, a sheet feed roller or a sheet conveying roller may be used to transmit a driving force to the waste toner transporter (e.g., auger). However, if a sheet is fed from a sheet feed port without using such sheet feed roller or the sheet conveying roller, the waste toner transporter (e.g., auger) is not driven by the sheet feed roller.

If such a sheet feed port is used continuously to feed the transfer sheet, waste toner may clog the waste toner pipe because the waste toner transporter (e.g., auger) is not driven by the sheet feed roller or the sheet conveying roller.

In addition, if the sheet feed roller is activated to drive the waste toner transporter (e.g., auger) when the above-mentioned sheet feed port is used for sheet feeding, another transfer sheet is also fed from the sheet feed roller. If another transfer sheet is fed in addition to the transfer sheet fed from the above-mentioned sheet feed port, an image forming apparatus may cause a drawback on image forming operation.

Hereinafter a case using a sheet conveying roller to drive the waste toner transporter (e.g., auger) is briefly explained.

When the sheet conveying roller transports transfer sheets, the sheet conveying roller drives the waste toner transporter (e.g., auger), thereby a flattening operation of the piled toner can be conducted properly.

However, when one image forming operation or a continuous image forming operation is conducted without transporting a transfer sheet, the waste toner transporter (e.g., auger) is not driven by the sheet conveying roller even though toner is recovered in the waste toner tank. Thus, the waste toner is not flattened in the waste toner tank, and clogging of waste toner pipe may occur, or a toner sensor may detect an untimely (i.e., premature) "toner-full" condition in the waste toner tank.

The above-mentioned image forming operation without transporting the transfer sheet includes "image concentration adjustment" and "color displacement adjustment," for example.

In case of the "image concentration adjustment," a predetermined image pattern is formed on a photoconductive member, and transferred to an intermediate transfer belt. Then an image concentration sensor reads concentration information of the image. Based on such information, image forming conditions can be automatically adjusted.

In case of the "color displacement adjustment," color displacement of four color images superimposed on the intermediate transfer belt from the four process cartridges is corrected.

Such correction is conducted when power is supplied to an image forming apparatus or during continuous printing, for example. As similar to the "image concentration adjustment," a predetermined image pattern is formed on a photoconductive member, and transferred to an intermediate transfer belt. Then a sensor reads image information. Based on such information, image forming conditions such as traveling speed of the intermediate transfer belt, timing and position of optical writing are corrected.

SUMMARY OF THE INVENTION

The present disclosure relates to an image forming apparatus including a waste toner collecting unit, a moving device, a sheet conveying roller, a driving unit, and a drive force transmitting unit. The waste toner collecting unit receives waste toner.

The moving device moves the waste toner in the waste toner collecting unit. The sheet conveying roller transports a transfer sheet. The driving unit drives the sheet conveying roller. The drive force transmitting unit interlinks the moving device to the sheet conveying roller, and transmits a drive force of the driving unit to the moving device via a shaft of the sheet conveying roller.

One non-limiting embodiment of the invention includes an image forming apparatus, including, a waste toner collecting unit configured to receive waste toner, a moving device configured to move the waste toner in the waste toner collecting unit, a sheet conveying roller configured to transport a transfer sheet, a driving unit configured to drive the sheet conveying roller; and a drive force transmitting unit, interlinking the moving device to the sheet conveying roller, and configured to transmit a drive force of the driving unit to the moving device via the sheet conveying roller.

Another non-limiting embodiment of the invention includes a method of moving waste toner in a waste toner tank of an image forming apparatus to even a height of the waste toner by moving a moving device provided in the waste toner tank and interlinked to a sheet conveying roller. The method includes: forming a toner image in response to an operation mode, driving the sheet conveying roller, transmitting a driving force of the sheet conveying roller to the moving device, and moving the moving device to move the waste toner in the waste toner tank.

Another non-limiting embodiment of the present invention includes an image forming apparatus, including, means for collecting waste toner, means for moving the waste toner in the means for collecting, a sheet conveying roller configured to transport a transfer sheet in the image forming apparatus, means for driving the sheet conveying roller, and means for transmitting a drive force of the means for driving to the means for moving via the sheet conveying roller.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF THE PREFERRED EMBODIMENTS

Figure 1:
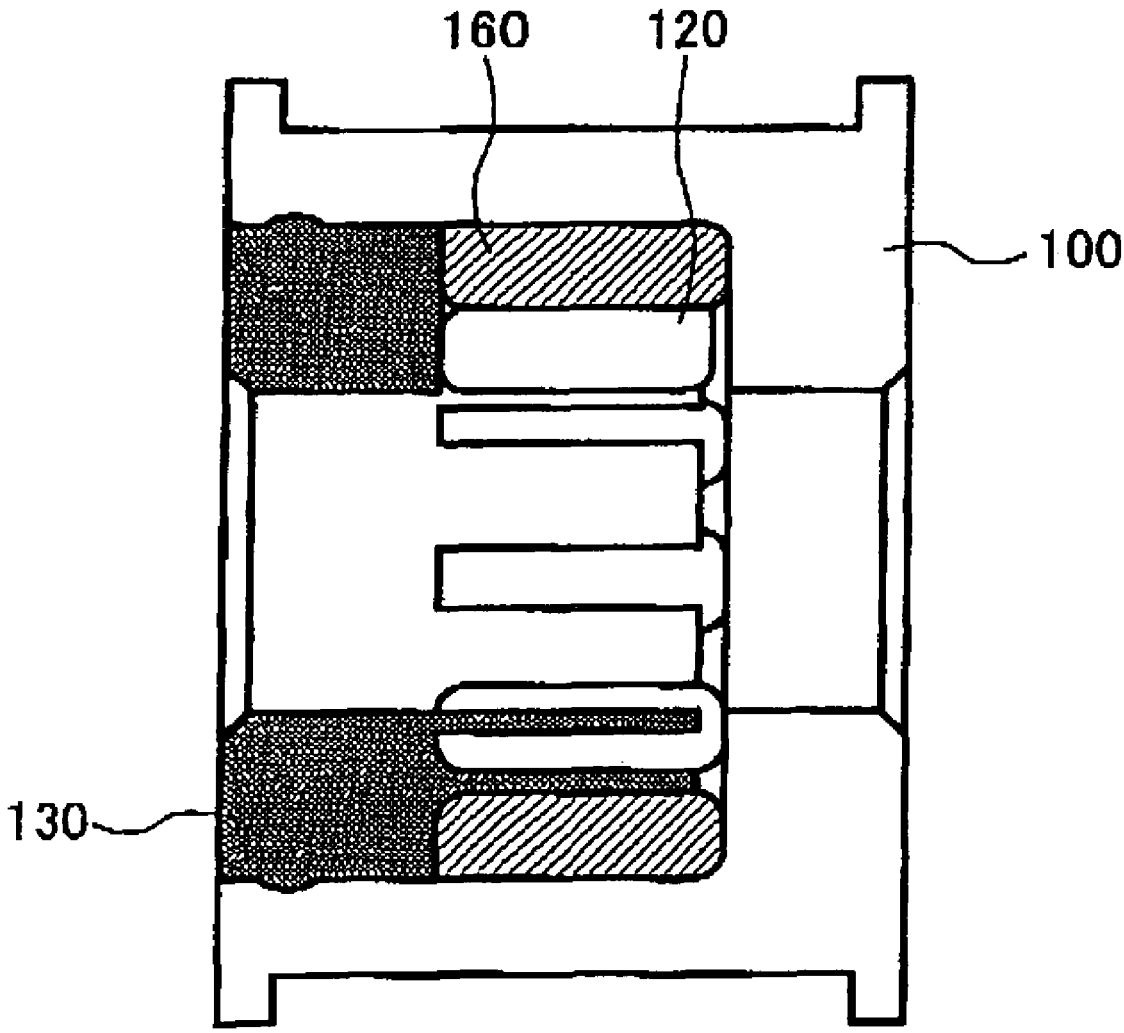
FIG. 1 BACKGROUND ART
FIG. 1 is a vertical sectional view of a background reverse preventing mechanism for sheet conveying rollers used in a background image forming apparatus.

In describing exemplary embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, and more particularly to FIGS. 4 to 7 thereof, an image forming apparatus according to one non-limiting embodiment is described.

Figure 4:
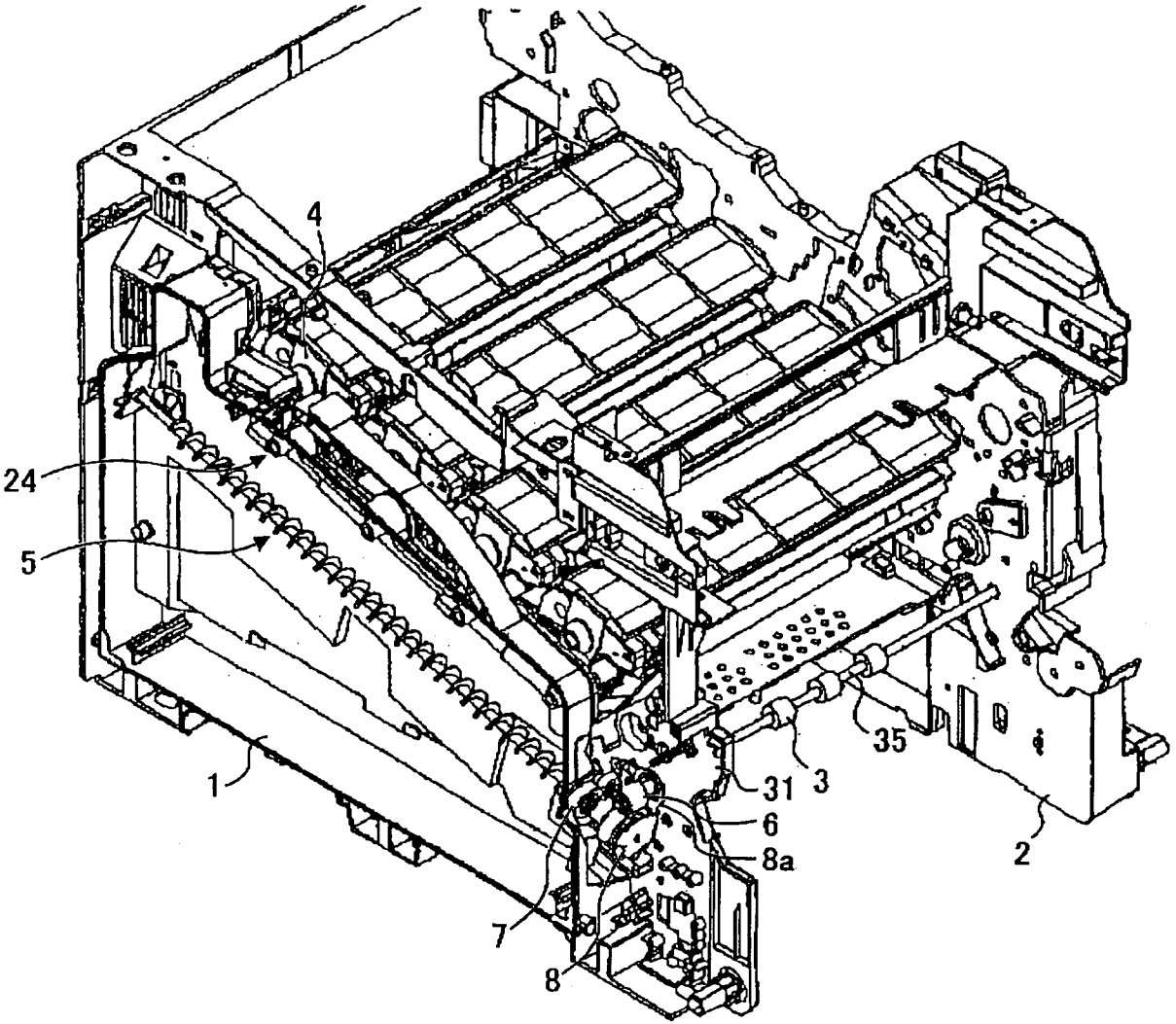
FIG. 4 is a perspective view of an image forming apparatus seen from the left side thereof according to an exemplary embodiment of the present invention.
Figure 5:
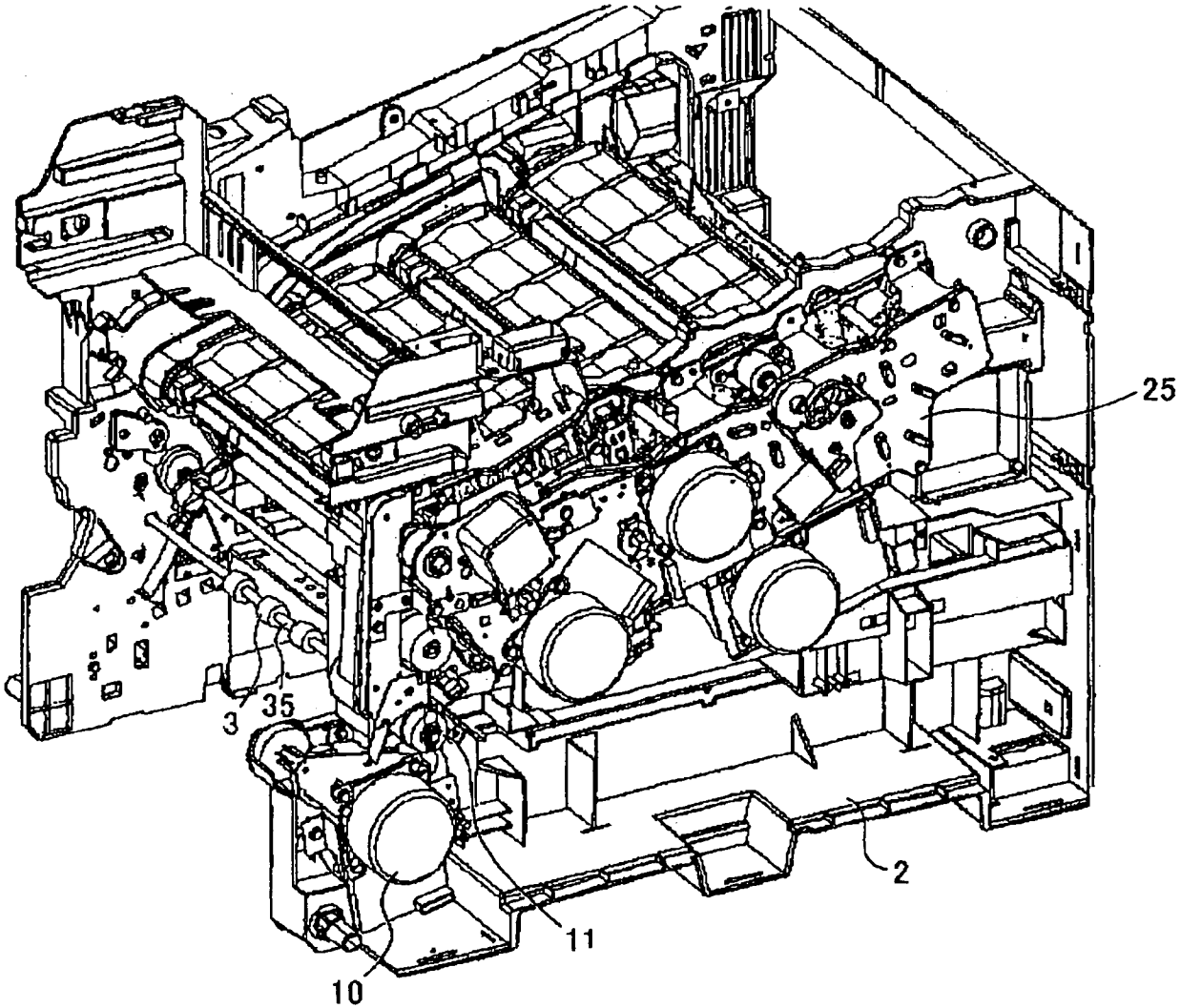
FIG. 5 is a perspective view of the image forming apparatus seen from the right side thereof according to an exemplary embodiment of the present invention.
Figure 7:
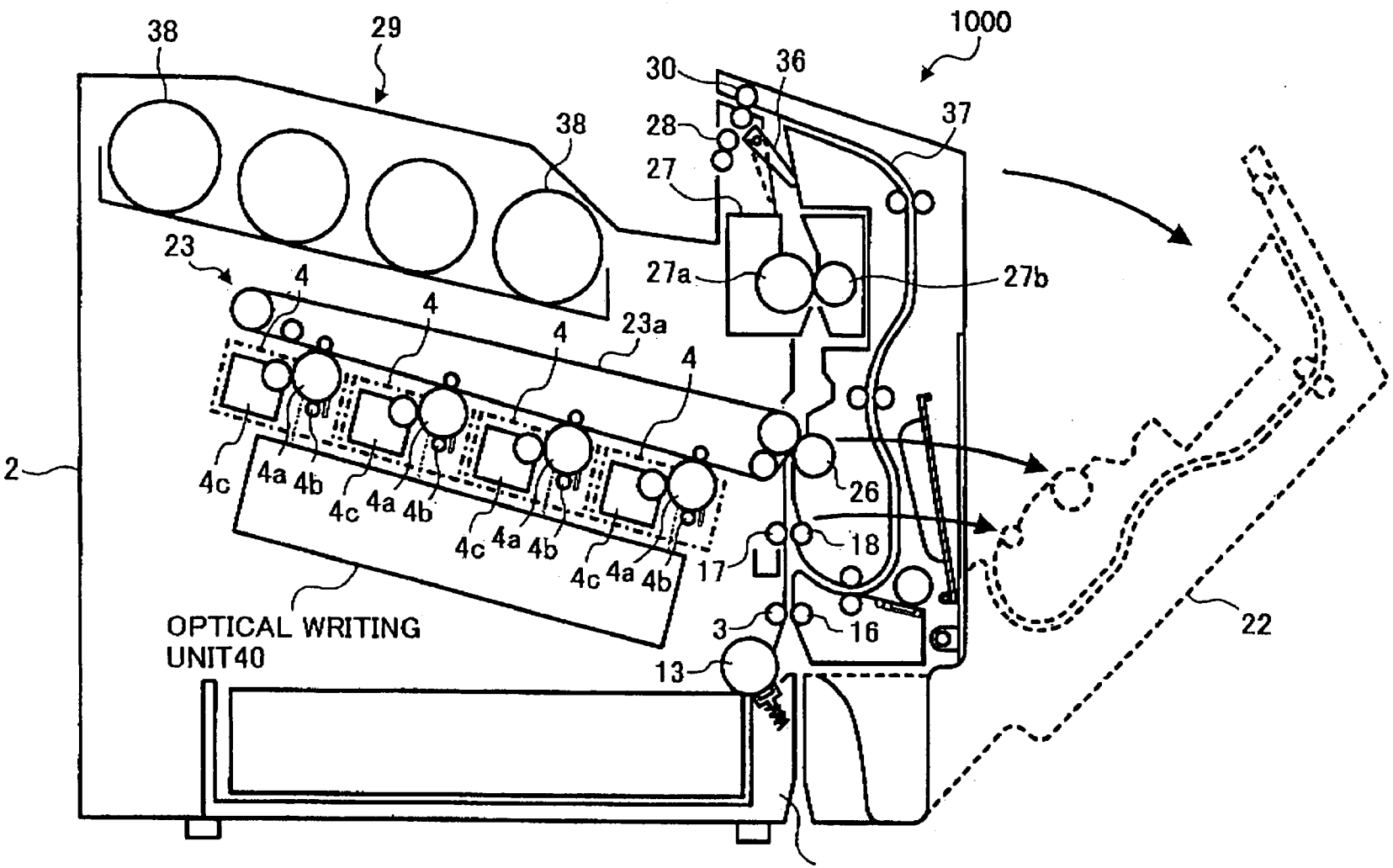
FIG. 7 is a vertical sectional view of the image forming apparatus to which a sheet feeding tray is attached according to an exemplary embodiment of the present invention.

As shown in FIGS. 4, 5 and 7, an image forming apparatus 1000 according to an exemplary embodiment of the present invention includes a main body frame 2 and a plurality of units and devices of the image forming apparatus 1000 are provided in the main body frame 2. The main body frame 2 is made of resinous material, for example.

As shown in FIGS. 4 and 7, four process cartridges 4 corresponding to four color toners are detachably attached to the main body frame 2.

Each of the process cartridges 4 includes a photoconductive member 4*a*, a charging roller 4*b*, a developing unit 4*c*, and a cleaning unit (not shown). However, the construction of the process cartridge 4 is not limited to that shown in FIG. 7. The four process cartridges 4 are attached to and detached from the main body frame 2 from the left side of the image forming apparatus in FIG. 4 and from the front side of the image forming apparatus in a direction perpendicular to the sheet of FIG. 7. Therefore, the maintenance of the apparatus and replacements of parts can be easily and smoothly carried out.

With reference to FIG. 7, an intermediate transfer belt unit 23 is detachably attached to the main body frame 2 above the process cartridges 4. Like the process cartridges 4, the intermediate transfer belt unit 23 is attached to and detached from the main body frame 2 from the front side of the image forming apparatus in a direction perpendicular to the sheet of FIG. 7.

Furthermore, an optical writing unit 40 is provided below the process cartridges 4 to form a latent image on the photoconductive member 4*a* of each of the process cartridges 4.

As shown in FIG. 4, a waste toner tank 1 is attached to the left side surface of the main body frame 2. In FIG. 4, the left side part of the image forming apparatus is cut away and opened.

The toner removed from each of the photoconductive members 4*a* in the process cartridges 4 is collected in the waste toner tank 1 through a waste toner pipe 24. The waste toner tank 1 is replaced by opening a left cover (not shown) of the apparatus. The waste toner tank 1 is configured to store four color toners. To even the height of toner accumulated in the waste toner tank 1, an auger 5 is disposed at the upper portion of the waste toner tank 1 to move the waste toner leftward in FIG. 4.

As shown in FIG. 4, a roller shaft 35 is disposed to cross a center opening portion of the main body frame 2. A plurality of sheet conveying rollers 3 are attached on the roller shaft 35. A drive force transmitting unit (described below) including a one-way clutch for transmitting a drive force to the auger 5 is disposed on the left end side of the roller shaft 35 in FIG. 4, and a drive system 25 for driving an image forming device (described below) of the image forming apparatus is disposed on the right end side of the roller shaft 35 as shown in FIG. 5.

With such a configuration, the auger 5 functions as a moving device. The moving device moves waste toner in the waste toner tank 1 in an exemplary embodiment.

Figure 6:
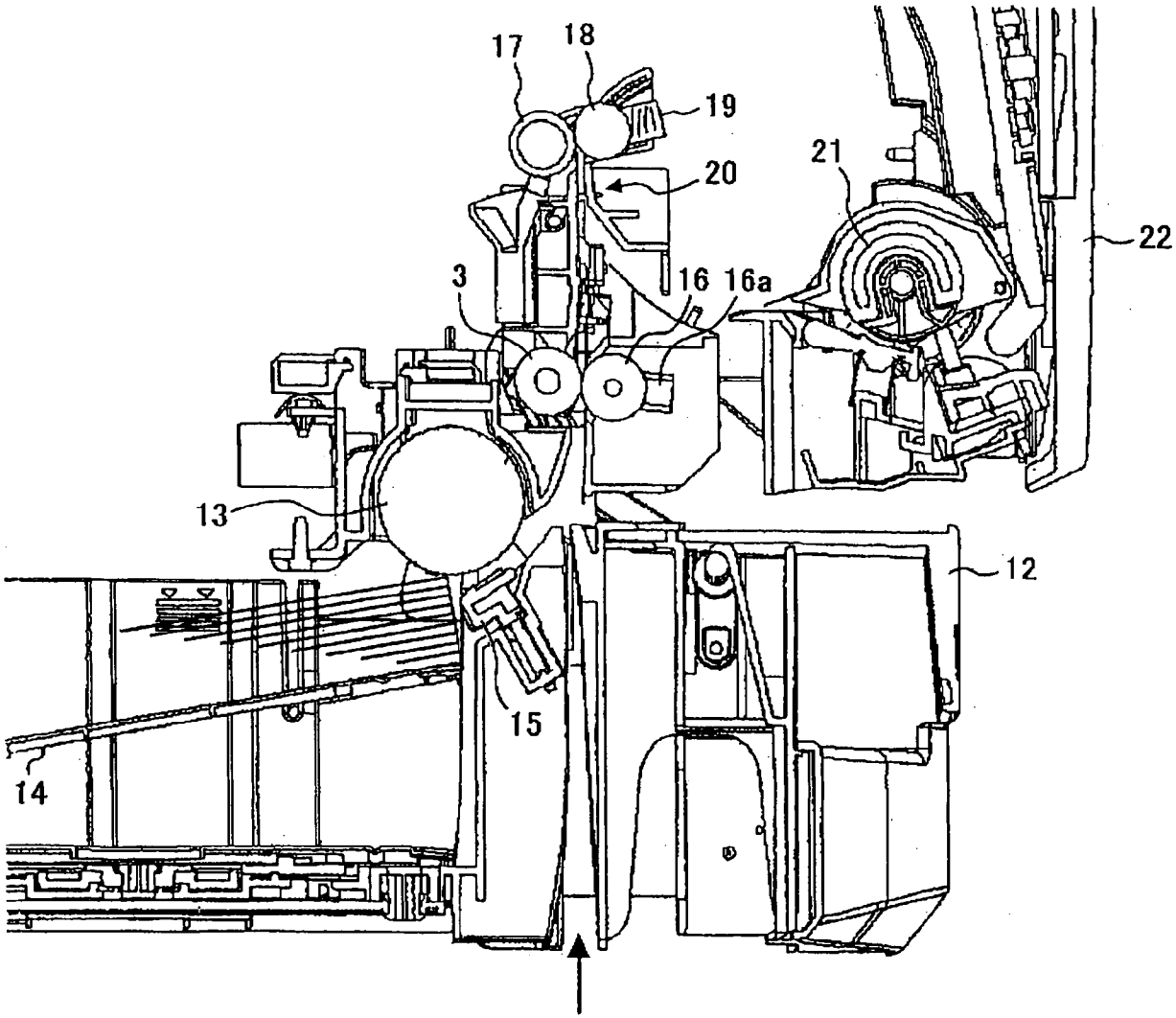
FIG. 6 is a mid-sectional view of a sheet conveying section of the image forming apparatus according to an exemplary embodiment of the present invention.

FIG. 6 illustrates a main portion of a sheet conveying mechanism including a sheet feeding tray when a front cover of the image forming apparatus 1000 is opened.

A sheet feed tray 12 is disposed below the main body frame 2. The sheets stacked on a bottom plate 14 of the sheet feed tray 12 are pressed toward a sheet feeding roller 13 by a spring (not shown), and the uppermost sheet of the stacked sheets contacts the sheet feeding roller 13 with pressure. Furthermore, a friction pad 15 acting as a sheet separating member contacts a circumferential surface of the sheet feeding roller 13.

When plural sheets abut the friction pad 15, the sheets other than the uppermost sheet are caused to stop proceeding due to friction caused by the friction pad 15. The sheet feeding roller 13 is rotated by a sheet feeding motor 10 via an electromagnetic clutch 11 shown in FIG. 5 to feed sheets toward the sheet conveying rollers 3 at a predetermined time.

As shown in FIG. 4, the roller shaft 35 is rotatably supported by the main body frame 2 via two bearings (not shown). The roller shaft 35 is typically formed from steel such as nickel-plated mild steel (SUM), and is inserted into the sheet conveying rollers 3 formed from ethylene propylene rubber. Of course, other materials may be used for the roller shaft 35 and conveying rollers 3.

Figure 10:
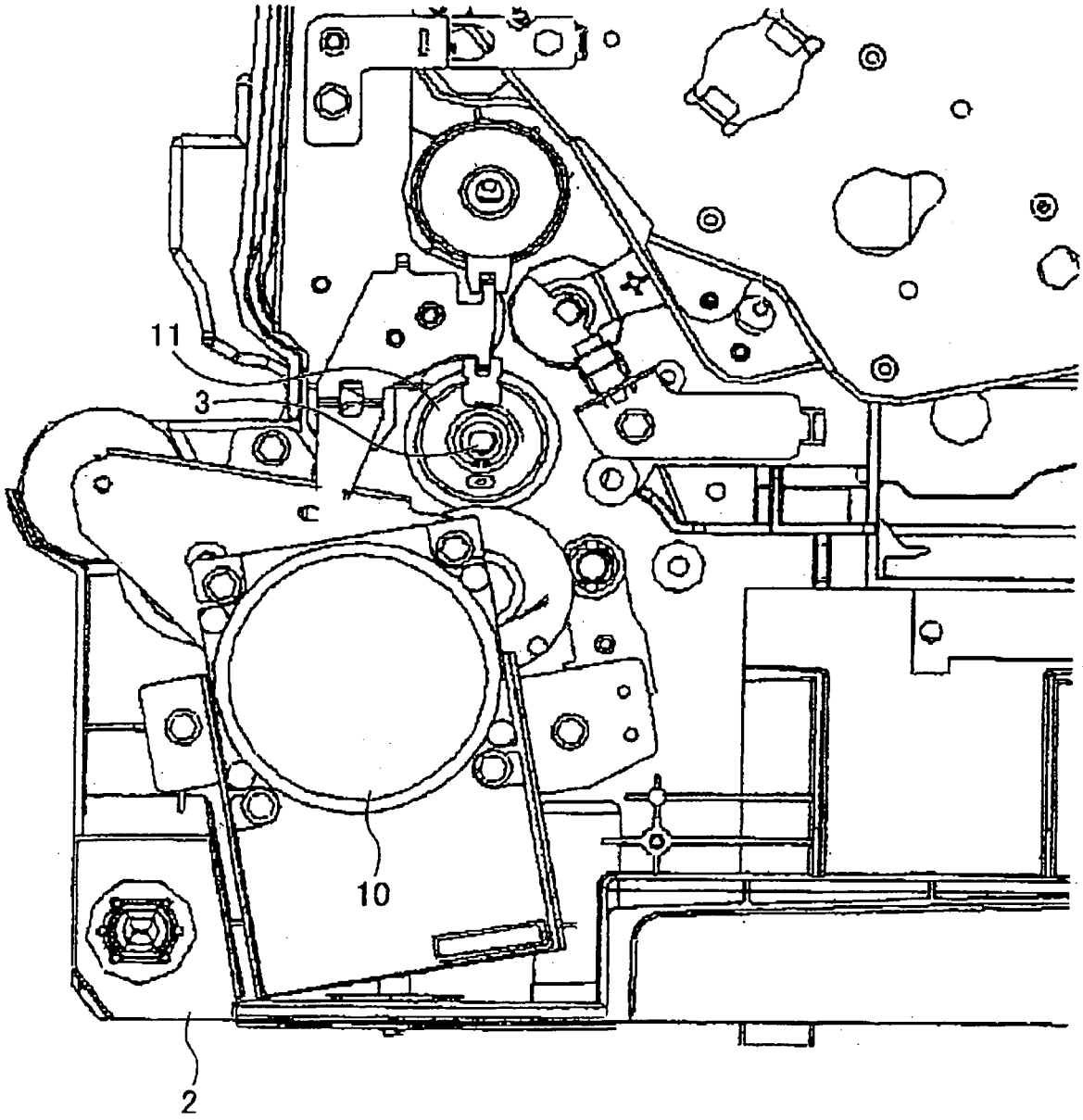
FIG. 10 is a right side view of a connecting section between a roller shaft of the sheet conveying rollers and a drive source for driving the sheet conveying rollers according to an exemplary embodiment of the present invention.

With reference to FIGS. 5 and 10, a drive force of the sheet feeding motor 10 disposed on the right side of the main body frame 2 is transmitted to the roller shaft 35 and the sheet conveying rollers 3 via the electromagnetic clutch 11.

The sheet conveying rollers 3 convey the sheet fed from the sheet feeding roller 13 toward a registration drive roller 17 and a registration driven roller 18 (shown in FIGS. 6 and 7) disposed at an upper side relative to the sheet conveying rollers 3. The registration drive roller 17 is at the downstream side of the sheet conveying rollers 3 with respect to the sheet conveying direction. The registration driven roller 18 is biased toward the registration drive roller 17 with a predetermined pressure by a spring 19 (shown in FIG. 6). Thus, the registration driven roller 18 is configured to apply a predetermined contact pressure to the sheet.

After a registration sensor 20 (shown in FIG. 6) disposed upstream of the registration drive roller 17 and the registration driven roller 18 with respect to the sheet conveying direction detects the leading edge of the sheet conveyed by the sheet conveying rollers 3, the sheet conveying rollers 3 continue to convey the sheet by a distance in which several extra millimeters are added on the distance between the registration sensor 20 and the nip portion between the registration drive roller 17 and the registration driven roller 18.

By this arrangement, the leading edge of the sheet is abutted against the nip portion between the registration drive roller 17 and the registration driven roller 18, and the sheet stops proceeding and forms a loop. As a result, the leading edge of the sheet is aligned, so that a sheet skew is corrected.

A reference numeral 16 in FIGS. 6 and 7 indicates a driven roller pairing up with each of the sheet conveying rollers 3. The driven roller 16 is biased toward the sheet conveying roller 3 with a predetermined pressure by a spring 16*a* (shown in FIG. 6) to apply a predetermined contact pressure to the sheet. A reference numeral 21 in FIG. 6 indicates a manual feeding roller provided to a front cover 22. The front cover 22 is pivotably supported by the lower end of the main body frame 2.

The front cover 22 is typically closed at the time of feeding sheets. The registration drive roller 17, the sheet conveying rollers 3, and the sheet feeding roller 13 are started to rotate in alignment to form a latent image on the photoconductive member 4*a*. The sheet feeding roller 13 stops rotating after feeding a trailing edge portion of a sheet. The sheet conveying rollers 3 keep rotating until a loop of the sheet is formed.

The registration drive roller 17 stops at a predetermined time when the registration sensor 20 detects the leading edge of the sheet to perform a sheet skew correction. Thus, when a sheet is fed out and conveyed from the sheet feed tray 12, the sheet conveying rollers 3 keep rotating until a loop of the sheet is formed for a sheet skew correction.

The sheet, having passed through the nip portion between the registration drive roller 17 and the registration driven roller 18, is conveyed toward an image transfer section along a sheet guide plate (not shown). Subsequently, images of different colors formed on an intermediate transfer belt 23*a* of the intermediate transfer belt unit 23 are sequentially transferred to the sheet conveyed by the registration drive roller 17 and the registration driven roller 18. During transfer, the images are superimposed on one another.

With reference to FIG. 7, a transfer roller 26 is provided downstream of the registration drive roller 17 and the registration driven roller 18 in the sheet conveying direction. The transfer roller 26 is used during the transfer of images formed on the intermediate transfer belt 23*a* to a sheet conveyed by the registration drive roller 17 and the registration driven roller 18.

Furthermore, a fixing device 27 is provided downstream of the transfer roller 26 in the sheet conveying direction. The fixing device 27 includes a fixing roller 27*a* and a pressure roller 27*b*. While a sheet passes through a nip portion between the fixing roller 27*a* and the pressure roller 27*b*, a transferred image is fixed onto the sheet by heat and pressure. The sheet having the fixed image is discharged by a pair of sheet discharging rollers 28 to a sheet discharging tray 29. In the image forming apparatus 1000, an image forming device that forms an image on a sheet is configured by the optical writing unit 40, the process cartridges 4, the intermediate transfer belt unit 23, the transfer roller 26, the fixing device 27, etc., for example.

The image forming apparatus 1000 has a configuration that allows images to be formed on dual sides (the first and second sides) of a sheet. When a dual-side image-forming mode is selected, the sheet passed through the fixing device 27 is directed to a reversing mechanism. The reversing mechanism includes a pair of reversing rollers 30, a separation pick 36, and a sheet conveying path 37.

When forming images on dual sides of a sheet, the separation pick 36 moves to the position illustrated by dotted lines in FIG. 7. Then, by the rotations of the reversing rollers 30, the sheet is reversed and conveyed to the sheet conveying path 37. The reversed sheet is conveyed toward the registration drive roller 17 and the registration driven roller 18 while passing through the sheet conveying path 37.

Subsequently, the registration drive roller 17 and the registration driven roller 18 feed the sheet to the nip portion between the intermediate transfer belt 23*a* and the transfer roller 26 again. The images of different colors that have been formed on the intermediate transfer belt 23*a* are sequentially transferred to the rear side of the sheet at the nip portion between the intermediate transfer belt 23*a* and the transfer roller 26 while being superimposed on one another.

In the above-described reversing mechanism, the transfer roller 26, the registration driven roller 18, and the manual feeding roller 21 are typically provided to the front cover 22. A sheet conveying path for conveying a sheet fed out from the sheet feed tray 12 is formed by closing the front cover 22.

Furthermore, toner bottles 38 containing respective color toners are provided below the sheet discharging tray 29. The toner bottles 38 can be replaced by opening the sheet discharging tray 29. That is, the sheet discharging tray 29 also acts as an upper cover of the image forming apparatus 1000.

Figure 8:
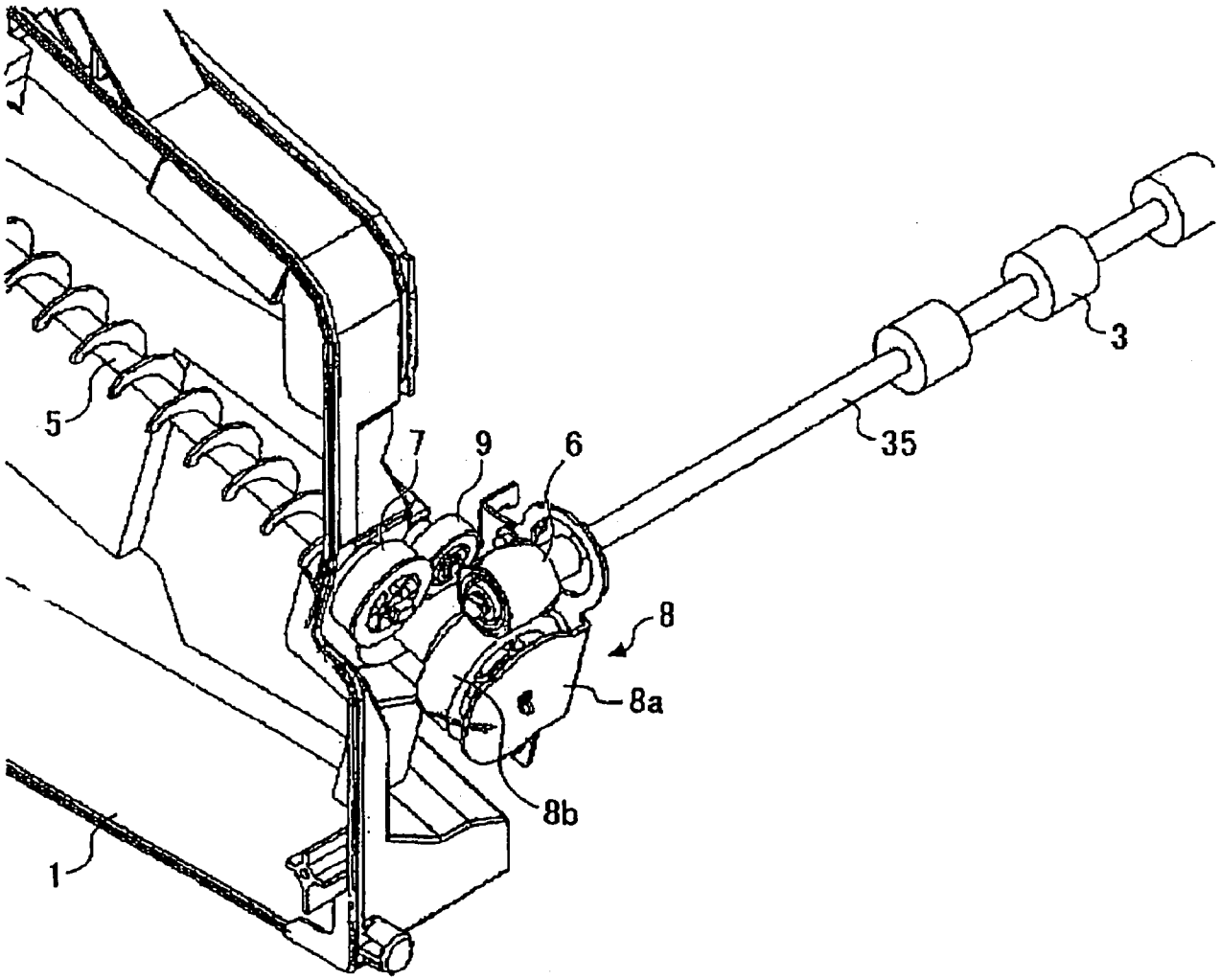
FIG. 8 is a perspective view of sheet conveying rollers, a drive force transmitting unit including a reverse preventing mechanism, and a waste toner tank according to the example embodiment of the present invention.

As shown in FIG. 8, a helical gear 6 is attached on the left-side end portion of the roller shaft 35 of the sheet conveying rollers 3, and rotates unitarily with the roller shaft 35. The helical gear 6 has a twist angle of about 45 degrees with respect to its rotational axis. The helical gear 6 is connected to an idler unit 8.

Figure 9:
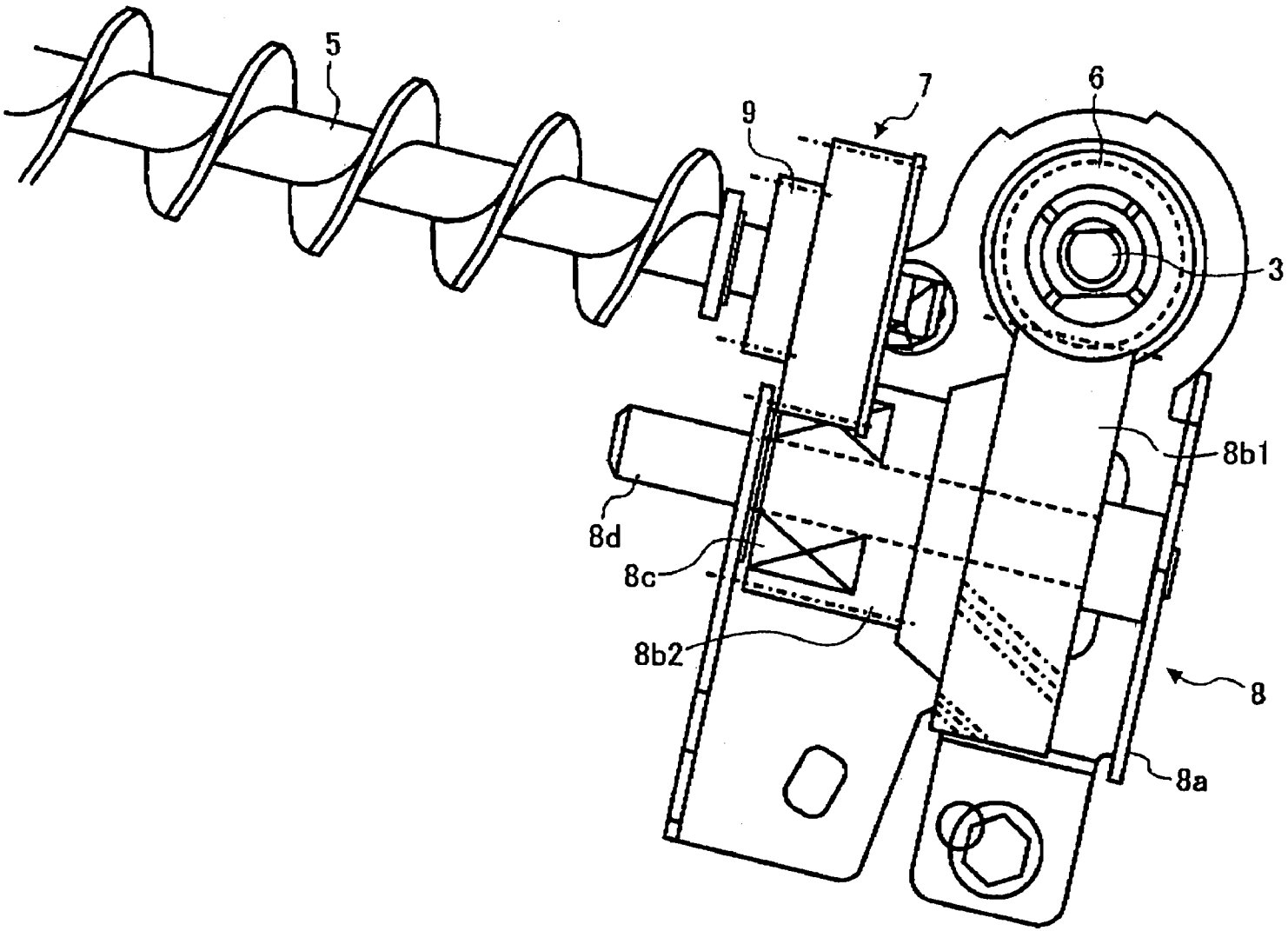
FIG. 9 is a left side view of the drive force transmitting unit and a drive section for driving the waste toner tank according to an exemplary embodiment of the present invention.
Figure 11:
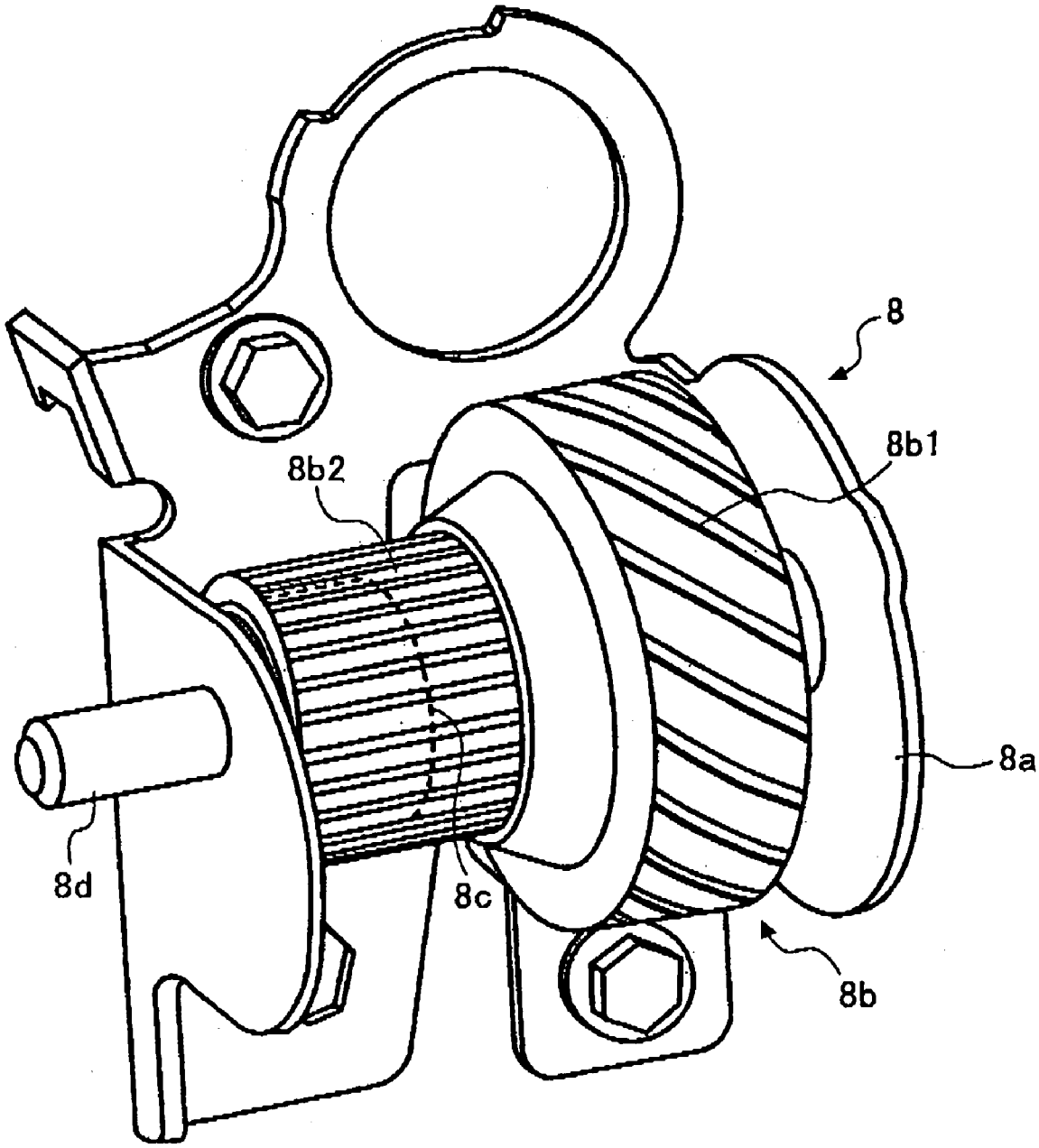
FIG. 11 is a perspective view of an idler unit acting as the drive force transmitting unit according to an exemplary embodiment of the present invention.

As shown in FIGS. 9 and 11, the idler unit 8 includes a bracket 8*a* typically formed from sheet metal, a shaft 8*d* fixed to the bracket 8*a*, and double gears 8*b* that rotate around the shaft 8*d*.

The double gears 8*b* include a helical gear 8*b*1 having a twist angle of about 45 degrees with respect to its rotational axis, and a spur gear 8*b*2. The helical gear 8*b*1 and the spur gear 8*b*2 are unitarily formed. The spur gear 8*b*2 unitarily formed with the helical gear 8*b*1 is attached on the shaft 8*d* via a one-way clutch (roller clutch) 8*c*. A single unit is formed by the bracket 8*a*, the double gears 8*b*, the one-way clutch 8*c*, and the shaft 8*d*.

Figure 2A:
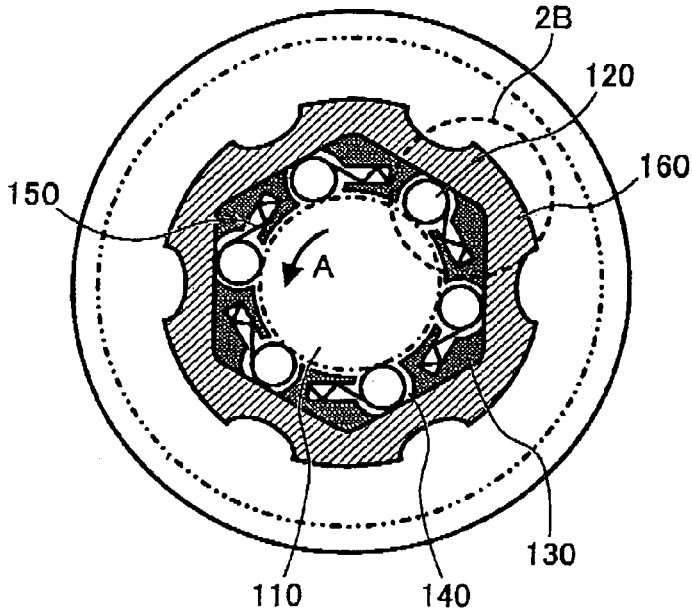
FIG. 2A BACKGROUND ART
FIG. 2A is a transverse sectional view of the background reverse preventing mechanism of FIG. 1.
Figure 2B:
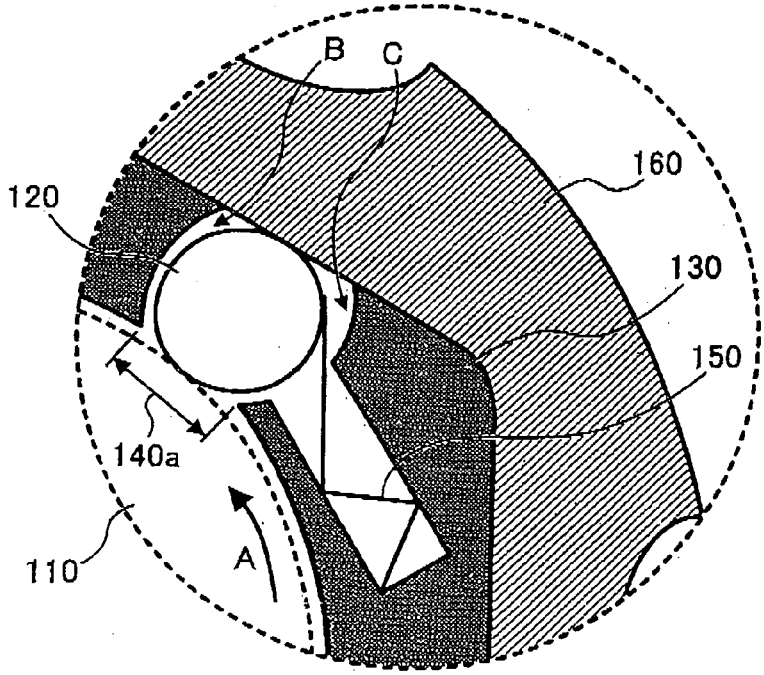
FIG. 2B BACKGROUND ART
FIG. 2B is an enlarged sectional view of a part of the background reverse preventing mechanism of FIG. 2A.
Figure 3:
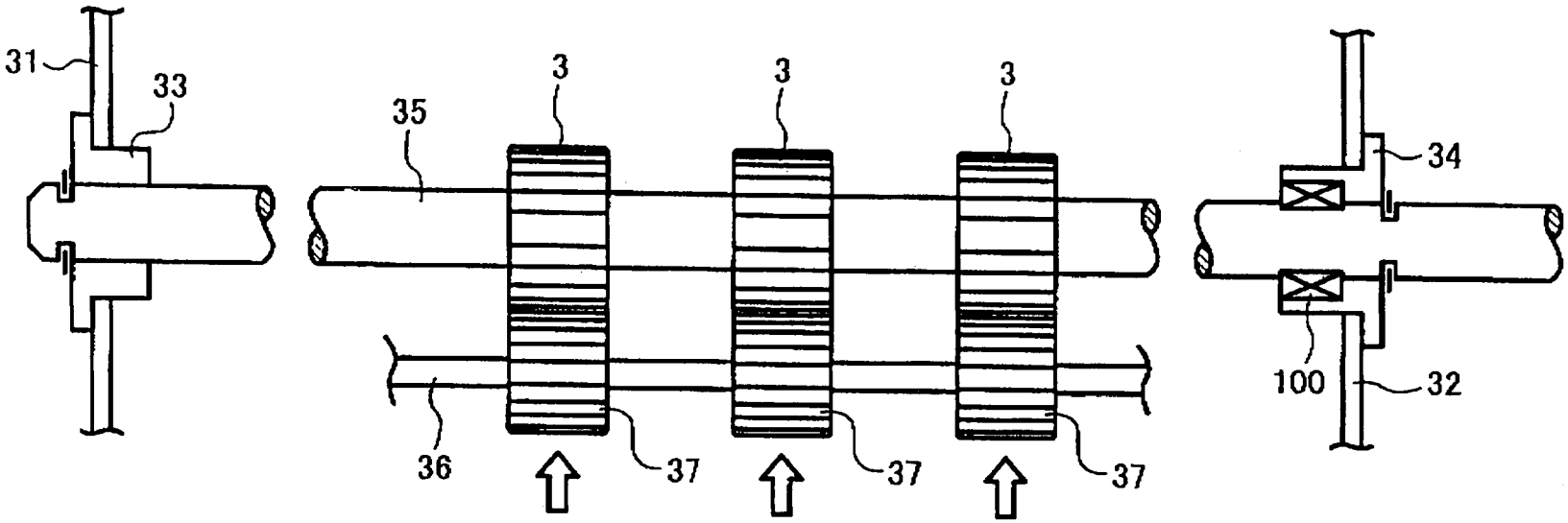
FIG. 3 BACKGROUND ART
FIG. 3 is a schematic view of a sheet conveying mechanism provided with the background reverse preventing mechanism for use in a background image forming apparatus.

The idler unit 8 is assembled by the following steps. After forming the bracket 8*a* (typically from sheet metal), the double gears 8*b* and the one-way clutch 8*c* are inserted into a space between two supporting portions of the bracket 8*a*. Next, after inserting the shaft 8*d* into the double gears 8*b* and the one-way clutch 8*c* through one of the supporting portions of the bracket 8*a*, two portions of the shaft 8*d* are crimped onto the two supporting portions of the bracket 8*a*, respectively. The one-way clutch 8*c* may be similar to the roller clutch 100 described with reference to FIGS. 1 through 3.

As shown in FIG. 4, the bracket 8*a* is attached to the front end side of a first side plate 31 disposed on the left side of the image forming apparatus in FIG. 4.

The helical gear 6 attached on the end portion of the roller shaft 35, which is rotatably supported by the first side plate 31, protrudes from the first side plate 31 leftward in FIG. 4 and engages the helical gear 8*b*1 of the double gears 8*b*. Specifically, in the bracket 8*a*, the helical gear 8*b*1 having a twist angle of about 45 degrees and the helical gear 6 having a twist angle of about 45 degrees are engaged with each other, and the drive force of the sheet feeding motor 10 is transmitted from the roller shaft 35 to the shaft 8*d* of the idler unit 8, which are in a cross positional relationship at about 90 degrees.

By this arrangement, as shown in FIGS. 8 and 9, the spur gear 8*b*2 of the double gears 8*b* engages a gear 7 attached on an end portion of a shaft of the auger 5 of the waste toner tank 1 via an idler gear 9. Thus, the roller shaft 35 of the sheet conveying rollers 3 and the shaft of the auger 5 can be driven by the same drive source, namely the sheet feeding motor 10.

As described above, the one-way clutch (roller clutch) 8*c* is inserted into the double gears 8*b* of the idler unit 8, typically with pressure. In order not to reverse the sheet conveying rollers 3 when the sheet conveying rollers 3 form a loop of a sheet, when the roller shaft 35 is about to rotate in the direction opposite from the drive direction, the one-way clutch 8*c* locks the shaft 8*d* of the idler unit 8 so as not to rotate the roller shaft 35 and the sheet conveying rollers 3. Thus, the one-way clutch 8*c* acts as a reverse preventing mechanism configured to prevent the roller shaft 35 from being rotated in a reverse direction.

By this arrangement, because a radial load exerted on the shaft 8*d* of the idler unit 8 is minimized, the shaft 8*d* may be formed from a material such as stainless steel and/or steel such as nickel-plated mild steel (SUM), which need not be subjected to quench hardening.

The combination of the helical gears 6 and 8*b*1 provides a reduction mechanism which may be configured to reduce a rotational speed of the one-way clutch 8*c* to be lower than a rotational speed of the roller shaft 35. With the reduction mechanism, frictional force between the shaft 8*d* and the one-way clutch 8*c* decreases. Thus, the abrasion of the shaft 8*d* can be lessened.

Even if the shaft 8*d* is subjected to a surface hardening processing, the surface hardening processing for the shaft 8*d* can be performed at low cost, as the axial length of the shaft 8*d* is only slightly longer than that of the double gears 8*b*.

As the idler unit 8 is unitized as described above, in the event of failure of the one-way clutch 8*c*, for example, the idler unit 8 can be repaired just by replacing the one-way clutch 8*c*, thereby allowing easy maintenance.

When a sheet is fed by the manual feeding roller 21 without being conveyed by the sheet conveying rollers 3, the drive force of the sheet feeding motor 10 is transmitted to the auger 5 of the waste toner tank 1 by turning on the electromagnetic clutch 11 at a predetermined time.

In the above-described example embodiment, the drive force transmitting direction of the roller shaft 35 is set to be substantially orthogonal to the drive force transmitting direction of the shaft of the auger 5. Therefore, a twist angle of each of the helical gears 6 and 8*b*1 is set to about 45 degrees. However, the twist angle of each of the helical gears 6 and 8*b*1 may be changed according to a relative angle between the respective drive force transmitting directions of the roller shaft 35 and the shaft of the auger 5. That is, according to a positional relationship between the roller shaft 35 and the shaft of the auger 5.

According to one exemplary embodiment of the present invention, the one-way clutch 8*c* and the roller shaft 35 of the sheet conveying rollers 3 are not in a coaxial relationship.

By this arrangement, the roller shaft 35 is not abraded at the attachment portion of the one-way clutch 8*c*, and the durability of the roller shaft 35 can thereby be enhanced. Therefore, the roller shaft 35 need not be formed from a material having a high hardness, and instead can be formed from a low-cost material.

In the above-described embodiment, when a rotational force of the roller shaft 35 is transmitted to the shaft 8*d* of the one-way clutch 8*c* via the helical gear 6 attached on the end portion of the roller shaft 35 and the helical gear 8*b*1 of the idler unit 8, the rotational speed of the one-way clutch 8*c* is reduced. The rotational speed of the one-way clutch 8*c* is typically lower than the rotational speed of the roller shaft 35.

Accordingly, a frictional force exerted on the shaft 8*d* can be decreased. Consequently, the abrasion of the shaft 8*d* at the attachment portion of the one-way clutch 8*c* can be minimized, and abrasion powders are not significantly produced. Thus, the durability of the one-way clutch 8*c* can be enhanced.

A generally-used shaft is formed from steel such as nickel-plated mild steel (SUM). However, a shaft used for a one-way clutch is often formed from an expensive stainless material or a special stainless material subjected to quench hardening to increase the hardness of the shaft. If a plated shaft is used for a one-way clutch, a plating layer is removed from the shaft due to contact with the one-way clutch, causing a lock failure.

However, if the rotational speed of and the radial load exerted on a shaft used for a one-way clutch is low, the shaft can be formed from steel such as nickel-plated mild steel (SUM) similar to that used in the generally-used shaft.

Further, in the above-described embodiments, because the auger 5 obtains a drive force by the rotations of the roller shaft 35, a drive source for driving the auger 5 need not be disposed independently. Therefore, the cost of the image forming apparatus can be decreased.

As described above, the roller shaft 35 of the sheet conveying rollers 3 is connected to the shaft of the auger 5 via the idler unit 8, and they are in a substantially orthogonal positional relationship. In this arrangement, the drive source for driving the roller shaft 35, namely the sheet feeding motor 10, is provided on the side opposite from the side where the idler unit 8 is provided in a direction of the shaft line of the roller shaft 35. Thus, a drive mechanism, for example, the drive system 25 for driving the image forming device and the sheet feeding motor 10 for driving the sheet feeding roller 13 and the roller shaft 35 of the sheet conveying rollers 3, can be located on the same side of the main body frame 2 in the image forming apparatus, thereby achieving a space-saving configuration of the image forming apparatus.

Moreover, according to the non-limiting exemplary embodiment of the present invention, the one-way clutch 8*c* is provided in the idler unit 8 to act as a reverse preventing mechanism configured to prevent the roller shaft 35 and the sheet conveying rollers 3 from being rotated in a reverse direction. Thus, the roller shaft 35 is not abraded by the reverse preventing mechanism (i.e., the one-way clutch 8*c*), and therefore the durability of a sheet conveying mechanism can be enhanced.

The idler unit 8 acts as a drive force transmitting unit connecting the roller shaft 35 (first shaft) to the shaft (second shaft) of the auger 5 via the idler unit 8. Accordingly, drive force of the sheet feeding motor 10 rotates the shaft of the auger 5 via the roller shaft 35.

In the above-described embodiment, the drive force of the sheet feeding motor 10 is transmitted from the roller shaft 35 (first shaft) to the shaft (second shaft) of the auger 5 that moves waste toner via the idler unit 8. In another embodiment, the drive force of the sheet feeding motor 10 may be transmitted from the roller shaft 35 to a shaft of the transfer roller 26, the fixing roller 27*a*, the sheet discharging rollers 28, or any other roller used in the image forming apparatus. Further, the reverse preventing mechanism of the present embodiment can be applied to any roller shaft that is desirable to be prevented from being reversed.

Moreover, aspects of the present invention can be applied to any type of image forming apparatus, such as: a copying machine, printer, facsimile machine, a multi-functional image forming apparatus, etc.

Figure 12:
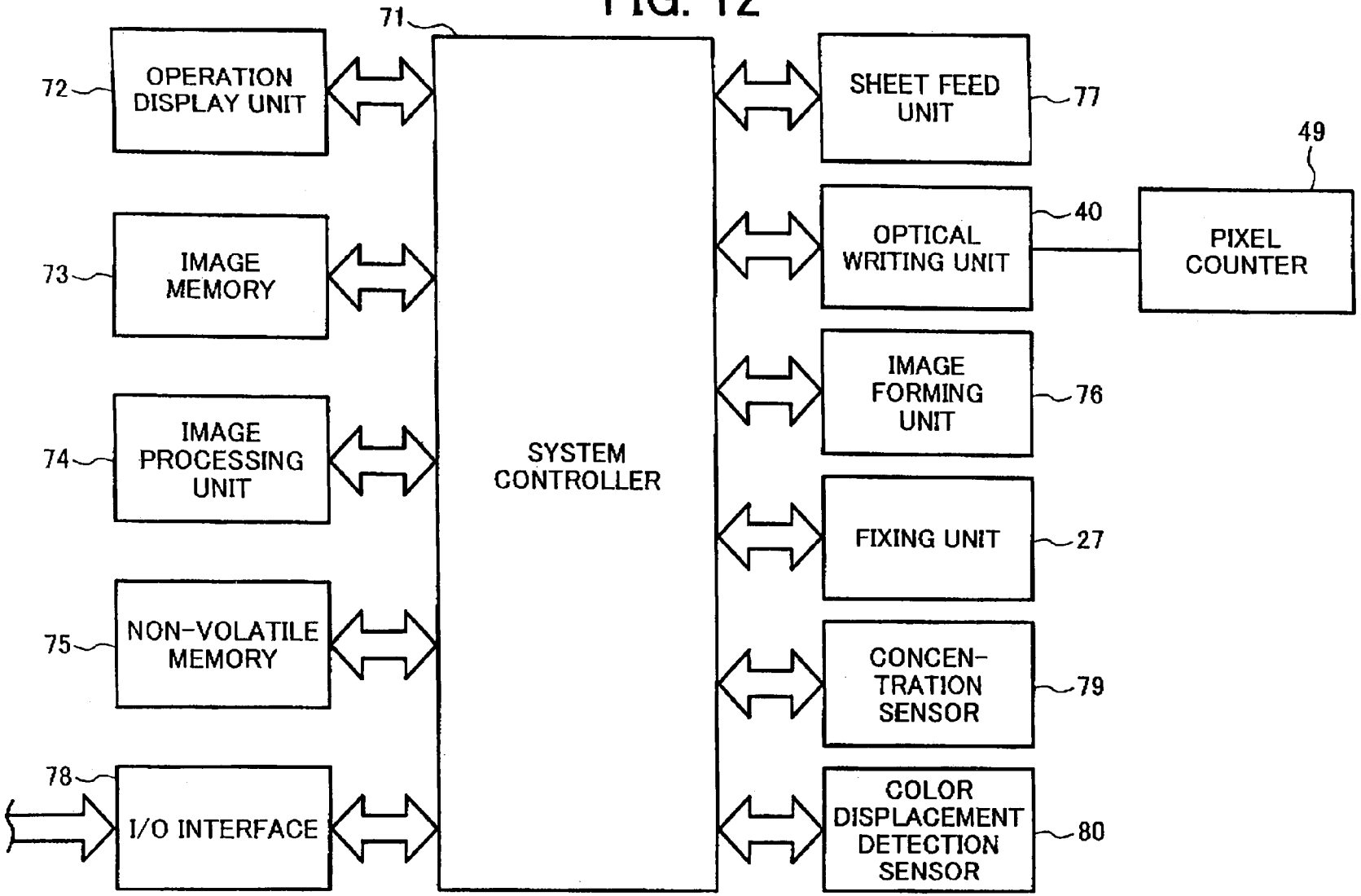
FIG. 12 is a block diagram showing a control configuration of an image forming apparatus according to an exemplary embodiment of the present invention.

FIG. 12 is a block diagram for a control configuration for use in the image forming apparatus 1000 according to an exemplary embodiment.

As shown in FIG. 12, a control circuit of the image forming apparatus 1000 includes a system controller 71, an operation display unit 72, an image memory 73, an image processing unit 74, a non-volatile memory 75, the optical writing unit 40, an image forming unit 76, the fixing unit 27, a sheet feed unit 77, an I/O (input/output) interface 78, a concentration sensor 79 and a color displacement detection sensor 80. The system controller 71 communicates information with the above-mentioned components.

When a user inputs an instruction through the operation display unit 72, the system controller 71 conducts a control operation corresponding to the instruction selected by the user.

When the system controller 71 receives an image data from the I/O interface 78, the image data is stored in the image memory 73 temporarily.

The image processing unit 74 conducts a predetermined image processing or a user-selected image processing to the image data.

The processed image data is transmitted to the optical writing unit 40, and the image forming unit 76 forms a toner image. Then the toner image is transferred and fixed to a transfer sheet fed from the sheet feed unit 77 and then discharged by the sheet discharging roller 28.

The above-mentioned processes are controlled by a control program stored in the non-volatile memory 75. The system controller 71 can control operations using the control program stored in the non-volatile memory 75.

The image forming unit 76 includes the process unit 4 for each color, the photoconductive member 4*a*, the charging roller 4*b*, the developing unit 4*c*, a primary transfer roller, and the cleaning unit (not shown).

The sheet feed unit 77 includes the sheet feed tray 12, the sheet feed roller 13, the sheet conveying roller 3, the sheet feed motor 10, and the electromagnetic clutch 11.

The image forming apparatus 1000 having the above-mentioned configuration includes an automatic image concentration adjusting device and a color displacement adjusting device.

An automatic adjustment of image concentration can be conducted as below.

At first, the charging roller 4*b* charges a surface of the photoconductive member 4*a* similarly to a normal image forming operation. Then, the optical writing unit 40 writes a predetermined image pattern to the surface of the photoconductive member 4*a*. The developing unit 4*c* develops the image pattern as toner image. Then, the primary transfer roller transfers the image pattern to the intermediate transfer belt 23*a*.

The image pattern transferred on the intermediate transfer belt 23*a* is read by the concentration sensor 79 provided in the vicinity of the surface of the intermediate transfer belt 23*a* to detect image concentration. The concentration sensor 79 may be a reflection type sensor, for example.

Based on the obtained image concentration data, and temperature data and humidity data obtained by a temperature sensor (not shown) and a humidity sensor (not shown), the image forming apparatus 1000 adjusts operating conditions such as charging bias voltage, developing bias voltage, and transfer bias voltage. The image forming apparatus 1000 can be programmed to conduct such automatic adjustment for image concentration periodically.

During the adjustment, automatic adjustment for image concentration can be conducted on each of the four process cartridges 4.

Therefore, in the exemplary embodiment of the present invention, the system controller 71 functions as a device that controls the automatic adjustment for image concentration.

When an automatic adjustment for image concentration is conducted in the image forming apparatus 1000 having the above-described configuration, the auger 5 is driven to move waste toner.

Such adjustment can be conducted when a transfer sheet is not transported as described below. For example, if an automatic image adjustment mode is activated during one job, the sheet feed motor 10 and the electromagnetic clutch 11 is turned "ON" to drive the sheet conveying roller 3, and the auger 5 is consequently driven by the above-described mechanism. In this case, one job means any kind of operations conducted in the image forming apparatus such as continuous image forming operation which produces a large number of printouts. The above-mentioned adjustment can also be conducted at other times such as after finishing one job and when a job is not conducted, for example.

During such automatic adjustment, an image pattern for concentration adjustment is formed on the photoconductive member 4*a* and the intermediate transfer belt 23*a* as a toner image. Then, the toner is cleaned and recovered to the waste toner tank by a recovery coil (not shown) as waste toner. The waste toner receives movement via the auger 5, driven by the above-described mechanism, to flatten piled waste toner in the waste toner tank 1.

Furthermore, the image forming apparatus 1000 can also include a color displacement adjustment device for adjusting color displacement.

A color displacement adjustment can be conducted similarly to the automatic image concentration adjustment.

At first, a charging unit charges each surface of the photoconductive member 4*a* similarly to normal image forming operations. Then the optical writing unit 40 writes a predetermined image pattern to a surface of the photoconductive member 4*a*. The developing unit 4*c* develops the image pattern as toner image. Then, the primary transfer roller transfers the image pattern to the intermediate transfer belt 23*a*.

The image pattern transferred on the intermediate transfer belt 23*a* is read by the color displacement detection sensor 80 provided to a vicinity of the surface of the intermediate transfer belt 23*a* to detect displacement. The color displacement detection sensor 80 may be a reflection type sensor, for example.

Based on the obtained displacement data, the image forming apparatus 1000 adjusts operation conditions such as traveling speed of intermediate transfer belt 23*a* and timing of optical writing to correct color displacement of each color on the intermediate transfer belt 23*a*. The image forming apparatus 1000 can be programmed to conduct such color displacement adjustment periodically.

When a color displacement adjustment is conducted in the image forming apparatus 1000 having the above-described configuration, the auger 5 is driven to move waste toner.

Such adjustment can be conducted when a transfer sheet is not transported. For example, if a color displacement adjustment mode is activated during one job, the sheet feed motor 10 and the electromagnetic clutch 11 is turned "ON" to drive the sheet conveying roller 3, and the auger 5 is consequently driven by the above-described mechanism. In this case, one job means any kind of operations conducted in the image forming apparatus such as a continuous image forming operation which produces a large number of printouts. The above-mentioned adjustment can be also conducted at any time such as after finishing one job or when a job is not conducted, for example.

During such automatic adjustment, an image pattern for color displacement adjustment is formed on the photoconductive member 4*a* and the intermediate transfer belt 23*a* as a toner image. Then, the toner image is cleaned and recovered to the waste toner tank by a recovery coil (not shown) as waste toner, and the waste toner receives a movement operation by the auger 5, driven by the above-described mechanism, to flatten piled waste toner in the waste toner tank 1.

As shown in FIG. 12, the image forming apparatus 1000 according to an exemplary embodiment also includes a pixel counter 49, which counts a number of pixels to be formed as image during image forming process.

The pixel counter 49 counts a number of times a laser beam is emitted when the optical writing unit 40 conducts optical writing to the photoconductive member 4*a* to form latent images. This information is stored in memory and used to determine a number of to be formed images. In another words, the pixel counter 49 is used to check an amount of toner to be consumed. Specifically, the system controller 71 determines the amount of toner to be consumed.

Such pixel counting can be conducted when a transfer sheet is not transported. For example, if a pixel counting mode is activated during one job, the sheet feed motor 10 and the electromagnetic clutch 11 is turned "ON" to drive the sheet conveying roller 3. The auger 5 is consequently driven by the above-described mechanism. In this case, one job means any kind of operations conducted in the image forming apparatus such as continuous image forming operation which produces a large number of printouts. The above-mentioned process can be also conducted at any time such as after finishing one job or when a job is not conducted, for example.

With an introduction of the pixel counter 49, a driving time of the auger 5 can be variably controlled based on counted pixel number.

For example, the image forming apparatus 1000 can be programmed not to move the auger 5 if the pixel count number is within a predetermined number, or can be programmed to move the auger 5 with a relatively longer time if the pixel count number is large.

Furthermore, whether an image forming is actually conducted in the image forming apparatus 1000 can be judged by the existence of dotting one pixel, for example.

A driving start time of the auger 5 can be set to various times. For example, the driving start timing of the auger 5 can be set to a time when the dotting of one pixel starts, or can be set to a time when a predetermined amount of dots are actually dotted.

Accordingly, the image forming apparatus 1000 according to an example embodiment preferably include following properties. As described above, the image forming apparatus 1000 includes the waste toner tank 1, the auger 5 which moves recovered waste toner in the waste toner tank 1, the sheet conveying roller 3 which transport transfer sheets, the idler unit 8 having the one-way clutch 8*c* to transmit a driving force from the sheet feed motor 10 to the sheet conveying roller 3, the spur gear 7, and the idler gear 9.

In the exemplary embodiment of the image forming apparatus 1000, driving force for the auger 5 can be transmitted from the sheet conveying roller 3, thereby the image forming apparatus 1000 does not require an additional driving system to drive the auger 5 in the waste toner tank 1. Thus, system cost is reduced.

Furthermore, the image forming apparatus 1000 can be configured to dispose a driving system and the waste toner tank 1 in a different position each other (e.g., an opposite side of the image forming apparatus 1000) to drive the auger 5, thereby the image forming apparatus 1000 can realize its space saving.

Furthermore, the sheet conveying roller 3 is disposed upstream of the image transfer position in the sheet conveying direction, wherein the image transfer position is used for transferring toner images to a transfer sheet, as shown in FIGS. 4, 5 and 7.

Thereby the sheet conveying roller 3 and the auger 5 can be disposed each other in a close proximity in the image forming apparatus 1000 having a plurality of image forming units (e.g., process cartridges) in a slanted manner.

Accordingly, a configuration of the idler unit 8 can be simplified, and consequently the image forming apparatus 1000 can realize its space saving. Furthermore, with such configuration, process cartridges can be detached easily.

Furthermore, the sheet conveying roller 3 is disposed upstream of the registration roller 17 in the sheet conveying direction as shown in FIG. 7.

With such a configuration, even if a transfer sheet is fed without passing through the sheet conveying roller 3 (e.g., when manual feed mode is used), the sheet conveying roller 3 can be driven at a predetermined time.

Therefore whenever a transfer sheet is fed from any sheet feed port (not shown), the sheet conveying roller 3 can rotate and transmit a driving force to the auger 5. Thereby, clogging by waste toner and untimely (i.e., premature) toner-full condition can be prevented.

As described above, during an image concentration adjustment by forming an image pattern on the photoconductive member 4*a* without feeding a transfer sheet, the sheet conveying roller 3 can be driven for a predetermined time. Thereby, driving force can be transmitted to the auger 5. Therefore, clogging by waste toner and untimely (i.e., premature) toner-full condition indications can be prevented.

As is the case with image concentration adjustment, during color displacement adjustment by forming an image pattern on the photoconductive member 4*a* without feeding a transfer sheet, the sheet conveying roller 3 can be driven for a predetermined time, thereby a driving force can be transmitted to the auger 5. Therefore, clogging by waste toner and untimely (i.e., premature) toner-full condition indications can be prevented.

As described above, during pixel number counting by using the pixel counter 49 without feeding a transfer sheet, the sheet conveying roller 3 can be driven when the system controller 71 detects pixel counting, thereby a driving force can be transmitted to the auger 5. Therefore, clogging by waste toner and untimely (i.e., premature) toner-full condition indications can be prevented.

As described above, during pixel number counting by using the pixel counter 49 without feeding a transfer sheet, the sheet conveying roller 3 can be driven with a variable driving time based on pixel counting number detected by the pixel counter 49, thereby a driving force can be transmitted to the auger 5. Accordingly, clogging by waste toner and untimely (i.e., premature) toner-full condition indications can be prevented.

The above specific embodiments are illustrative, and many variations on these embodiments are possible without departing from the spirit of the disclosure or from the scope of the appended claims. For example, elements and/or features of different illustrative embodiments may be combined with each other and/or substituted for each other within the scope of this disclosure and appended claims.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus, comprising:

a waste toner collecting unit configured to receive waste toner;

a moving device configured to move the waste toner in the waste toner collecting unit;

a sheet conveying roller configured to transport a transfer sheet;

a driving unit configured to drive the sheet conveying roller; and a drive force transmitting unit, interlinking the moving device to the sheet conveying roller, configured to transmit drive force from the driving unit to the moving device via the sheet conveying roller.

2. The image forming apparatus according to claim 1, wherein the sheet conveying roller is disposed upstream of an image transfer position in a sheet conveying direction, wherein the image transfer position is used for transferring a toner image to a transfer sheet.

3. The image forming apparatus according to claim 1, wherein the sheet conveying roller is disposed upstream of a registration roller in a sheet conveying direction.

4. The image forming apparatus according to claim 1, further comprising a controller configured to drive the sheet conveying roller at a predetermined time in response to an operation mode conducted in the image forming apparatus.

5. The image forming apparatus according to claim 4, wherein the operation mode includes a first mode in which an image forming operation is conducted while a transfer sheet is fed and transported in the image forming apparatus without passing through the sheet conveying roller.

6. The image forming apparatus according to claim 4, wherein the operation mode includes a second mode in which an image forming operation is conducted to perform an image concentration adjustment without transferring a toner image to a transfer sheet.

7. The image forming apparatus according to claim 4, wherein the operation mode includes a third mode in which an image forming operation is conducted to perform a color displacement adjustment without transferring a toner image to a transfer sheet.

8. The image forming apparatus according to claim 4, further comprising:

a pixel counter configured to count a number of pixels when an image forming operation is conducted, wherein the controller determines conduction of the image forming operation based on the number of pixels counted by the pixel counter, and wherein the controller drives the sheet conveying roller once the number of pixels counted by the pixel counter becomes at least a predetermined number.

9. The image forming apparatus according to claim 8, wherein the controller changes a driving time of the sheet conveying roller in response to the number of pixels counted by the pixel counter.

10. The image forming apparatus according to claim 1, wherein the sheet conveying roller includes a first shaft and the drive force transmitting unit includes a second shaft, wherein the second shaft is interlinked to the first shaft via the drive force transmitting unit, and wherein the second shaft is disposed at a position deviated from a shaft line of the first shaft of the sheet conveying roller.

11. The image forming apparatus according to claim 10, wherein the drive force transmitting unit is disposed at a position opposite of the position where the driving unit is disposed with respect to a shaft line of the first shaft of the sheet conveying roller.

12. The image forming apparatus according to claim 10, wherein the drive force transmitting unit comprises:

a bracket;

a fixing shaft fixed to the bracket;

a reverse preventing mechanism including a one-way clutch attached on the fixing shaft, the reverse preventing mechanism configured to prevent the sheet conveying roller from being rotated in a reverse direction; and gears attached on the fixing shaft through the one-way clutch.

13. The image forming apparatus according to claim 12, wherein the drive force transmitting unit further comprises a speed reduction mechanism.

14. The image forming apparatus according to claim 12, wherein the gears include a first gear and a second gear having a diameter smaller than a diameter of the first gear, and the drive force transmitting unit further comprises:

a third gear provided on the first shaft and that engages with the first gear; and a fourth gear provided on the second shaft and that engages with the second gear.

15. The image forming apparatus according to claim 14, wherein the first and third gears include helical gears, and a positional relationship between the first shaft and the second shaft corresponds to a twist angle of each of the helical gears with respect to a rotational axis of each of the helical gears.

16. The image forming apparatus according to claim 12, wherein the fixing shaft, the one-way clutch, and the gear are unitarily attached to the bracket.

17. An image forming apparatus, comprising:

means for collecting waste toner;

means for moving the waste toner in the means for collecting;

a sheet conveying roller configured to transport a transfer sheet in the image forming apparatus;

means for driving the sheet conveying roller; and means for transmitting a drive force of the means for driving to the means for moving via the sheet conveying roller.

18. A method of moving waste toner in a waste toner tank of an image forming apparatus to even a height of the waste toner by moving a moving device provided in the waste toner tank and interlinked to a sheet conveying roller, comprising:

forming a toner image in response to an operation mode;

driving the sheet conveying roller;

transmitting a driving force of the sheet conveying roller to the moving device; and moving the moving device to move the waste toner in the waste toner tank.

19. The method according to claim 18, further comprising driving the sheet conveying roller for a predetermined time in response to the operation mode conducted in the image forming apparatus.

20. The method according to claim 19, wherein the operation mode includes a first mode in which an image forming operation is conducted while a transfer sheet is fed and transported in the image forming apparatus without passing through the sheet conveying roller.

21. The method according to claim 19, wherein the operation mode includes a second mode in which an image forming operation is conducted to perform an image concentration adjustment without transferring a toner image to a transfer sheet.

22. The method according to claim 19, wherein the operation mode includes a third mode in which an image forming operation is conducted to perform a color displacement adjustment without transferring a toner image to a transfer sheet.

23. The method according to claim 19, further comprising:

counting a number of pixels when an image forming operation is conducted;

determining conduction of the image forming operation based on the number of pixels counted by the pixel counter; and driving the sheet conveying roller once the number of pixels becomes at least a predetermined number.

24. The method according to claim 23, further comprising changing a driving time of the sheet conveying roller in response to the number of pixels counted.

* * * * *